US009487331B2

(12) United States Patent
Bennett

(10) Patent No.: US 9,487,331 B2
(45) Date of Patent: Nov. 8, 2016

(54) OIL CONTAINMENT BAG/CONTAINER FOR THE TRANSPORTING AND STORAGE OF ELECTRICAL TRANSFORMERS OF ALL TYPES (I.E. ALL POLE, PAD MOUNT AND UNDERGROUND MODELS ETC.)

(71) Applicant: William Duffy Bennett, Chicago, IL (US)

(72) Inventor: William Duffy Bennett, Chicago, IL (US)

(73) Assignee: ABG Bag, Inc., Rockford, IL (US)

( * ) Notice: Subject to any disclaimer, the term of this patent is extended or adjusted under 35 U.S.C. 154(b) by 122 days.

(21) Appl. No.: 14/328,426

(22) Filed: Jul. 10, 2014

(65) Prior Publication Data

US 2014/0319019 A1 Oct. 30, 2014

Related U.S. Application Data

(63) Continuation of application No. 12/832,064, filed on Jul. 7, 2010, now Pat. No. 8,777,001.

(51) Int. Cl.

| | |
|---|---|
| ***B65D 85/00*** | (2006.01) |
| ***B65D 30/08*** | (2006.01) |
| ***B65D 33/02*** | (2006.01) |
| ***B65D 33/06*** | (2006.01) |

(52) U.S. Cl.

CPC ..... *B65D 29/02* (2013.01); *B65D 33/02* (2013.01); *B65D 33/065* (2013.01); *B65D 85/00* (2013.01)

(58) Field of Classification Search

USPC ..... 206/701

See application file for complete search history.

(56) References Cited

U.S. PATENT DOCUMENTS

| | | | | |
|---|---|---|---|---|
| 4,233,888 | A | 11/1980 | LaFleur | |
| 4,279,183 | A | 7/1981 | LaFleur | |
| 4,481,006 | A | 11/1984 | LaFleur et al. | |
| 4,518,106 | A | 5/1985 | LaFleur | |
| 4,596,040 | A | 6/1986 | LaFleur et al. | |
| 4,718,925 | A | 1/1988 | DeMarco | |
| 4,738,547 | A * | 4/1988 | Brown | A45C 7/0095 383/119 |
| 4,781,472 | A | 11/1988 | LaFleur et al. | |
| 4,781,473 | A | 11/1988 | LaFleur | |
| 4,781,475 | A | 11/1988 | LaFleur | |
| 4,790,029 | A | 12/1988 | LaFleur et al. | |
| 4,798,572 | A | 1/1989 | LaFleur et al. | |
| 4,817,824 | A | 4/1989 | LaFleur et al. | |
| 4,890,936 | A | 1/1990 | Cooper | |
| 4,969,750 | A | 11/1990 | Russo et al. | |
| 5,087,235 | A | 2/1992 | LaFleur | |
| 5,104,236 | A | 4/1992 | LaFleur | |

(Continued)

*Primary Examiner* — Jacob K Ackun

(74) *Attorney, Agent, or Firm* — Scherrer Patent & Trademark Law, P.C.; Stephen T. Scherrer; Monique A. Morneault

(57) ABSTRACT

A leak-tight/water-proof transformer containment bag includes (i) an outer puncture-resistant liquid-barrier fabric bag with a bottom having an oil-absorbent cushioning mat; (ii) a middle tear-resistant liquid-impervious continuous-sheet bag liner secured inside the outer bag; (iii) an inner puncture-resistant liquid-barrier fabric bag secured inside the liner; the bottom of the inner bag having outer and inner cushioning oil-absorbent mats; the outer bag, middle liner and inner bag being secured together at their open ends; (iv) lifting loops secured on opposite sides at the front and back of the outer bag and extending above the top of the outer bag to enable grabbing and lifting the lifting loops from above; (v) reinforcing bands secured around the outer bag and lifting loops; and (vi) a duffel top secured openly over the open top of the bags; the duffel top having a closure for closing the duffel top and closing off the top of the bags.

18 Claims, 9 Drawing Sheets

(56) References Cited

U.S. PATENT DOCUMENTS 5,127,893 A 7/1992 LaFleur
5,199,795 A 4/1993 Russo et al.
5,328,268 A 7/1994 LaFleur
5,358,335 A 10/1994 LaFleur
5,385,268 A 1/1995 LaFleur et al.
5,421,804 A 6/1995 LaFleur
5,423,611 A * 6/1995 Sherrard ..... B65D 88/1668 383/107
5,507,859 A 4/1996 Kaiser
5,607,237 A 3/1997 LaFleur
5,618,254 A 4/1997 Derby
5,664,887 A 9/1997 LaFleur
5,690,253 A 11/1997 LaFleur
5,701,650 A 12/1997 LaFleur et al.
5,758,973 A 6/1998 LaFleur
5,759,144 A 6/1998 Derby
5,794,670 A 8/1998 LaFleur
5,810,478 A 9/1998 LaFleur
5,836,363 A 11/1998 LaFleur
5,851,072 A 12/1998 LaFleur
5,865,541 A 2/1999 LaFleur
5,897,012 A 4/1999 Sortwell
5,918,984 A 7/1999 LaFleur et al.
5,944,251 A 8/1999 LaFleur
5,984,850 A 11/1999 Derby
6,079,934 A 6/2000 Beale et al.
6,090,029 A 7/2000 LaFleur
6,123,654 A 9/2000 LaFleur
6,139,482 A 10/2000 LaFleur
6,155,772 A 12/2000 Beale et al.
6,281,477 B1 8/2001 Forrester et al.
6,302,299 B1 10/2001 Baker et al.
6,371,646 B1 4/2002 LaFleur
6,827,218 B1 12/2004 Dick et al.
6,921,201 B2 * 7/2005 Richardson, Jr. .. B65D 88/1625 220/495.03
7,021,825 B1 * 4/2006 Schultz ..... A47D 15/00 224/438
7,341,377 B1 * 3/2008 Baxter ..... A45C 11/00 294/159
7,510,327 B2 3/2009 Williams et al.
2002/0038745 A1 4/2002 Lamming
2003/0056473 A1 * 3/2003 Matias ..... B65B 3/045 53/469
2007/0047853 A1 * 3/2007 Sharp ..... B31B 23/00 383/106
2007/0053615 A1 3/2007 Liu et al.
2007/0084866 A1 * 4/2007 Saeugling ..... B65D 31/02 220/495.06
2007/0127852 A1 * 6/2007 Town ..... B65D 88/1618 383/16
2008/0159660 A1 7/2008 Roell
2008/0187252 A1 * 8/2008 Dabrazzi ..... A45C 3/04 383/12
2008/0292225 A1 11/2008 Dayrit et al.
2009/0078709 A1 * 3/2009 Murrer, III ..... G21F 9/36 220/592.2
2009/0256680 A1 10/2009 Kilian
2011/0044564 A1 * 2/2011 Lin ..... B65D 88/1618 383/37
2012/0155787 A1 * 6/2012 Powell ..... B65D 90/24 383/25
2013/0037442 A1 2/2013 Brendel

* cited by examiner

OIL CONTAINMENT BAG/CONTAINER FOR THE TRANSPORTING AND STORAGE OF ELECTRICAL TRANSFORMERS OF ALL TYPES (I.E. ALL POLE, PAD MOUNT AND UNDERGROUND MODELS ETC.)

The present invention is a continuation of U.S. Non-provisional patent application Ser. No. 12/832,064 entitled, "Oil Containment Bag/Container for The Transporting and Storage of Electrical Transformers of All Types (I.E. All Pole, Pad Mount and Underground Models Etc.)," having a filing date of Jul. 7, 2010, which is hereby incorporated by reference in its entirety.

FIELD OF THE INVENTION

The present invention relates to a containment bag for transporting and storage of electrical transformers. More particularly, the invention relates to a containment bag capable of carrying electrical transformers such as of a type used in commercial, power distribution and industrial applications, and preventing leaking of both hazardous and non-hazardous materials from such transformers when in the containment bag into the outside environment, including but not limited containing mineral oil, PCB and any other type of liquid and hazardous material within the transformers.

BACKGROUND OF THE INVENTION

Electrical transformers such as of a type used in commercial, power distribution and industrial applications are typically constructed with the transformer coils located in a housing that is filled with liquid to achieve desired electrical insulation and thermal cooling characteristics. Liquids used for this purpose include various oil formulations and hazardous chemicals. In many instances, leaking of these fluids from transformers can cause environmental damage, violate certain civil codes, and result in the levying of significant fines. Thus, there is an ever present need to prevent leaking from transformers into the outside environment.

Transformers can start leaking for a number of common reasons, generally related to either damage to the transformer housing or time in service, and as such, development of leaks are often not preventable. By the time maintenance personnel reaches a leaking transformer, the leaking of fluid will have typically stopped. The significant problem for the maintenance personnel is to remove the leaking transformer and return it to a repair facility without leaking additional fluid. Thus, a cause of transformers needlessly leaking fluid into the outside environment is during the course of handling a leaking transformer, including removal of the installed transformer and transport of the transformer to a repair facility.

Prior transformer containment bags provide no capability of lifting or carrying or moving the transformer. The transformer cannot be lifted or picked up and moved with the containment bag. In order to move a transformer, the lift device must connect to the transformer. Thus, even if the containment bag is secured to the transformer, portions of the transformer are not contained within the bag during movement of the transformer by the lift device, which presents the danger of further leaking from the transformer to the outside environment when transformer is, for example, lowered onto a pallet or truck for transport to a storage or repair facility. This danger is enhanced where the leak is located above the lift locations on the transformer, such as when bushing which are located above the lift locations of pole mount transformers leak due to time in service.

During transport to a storage or repair facility, such as in the back of a repair truck, the transformers can experience significant bouncing and "knocking-around" during which prior transformer containment bags provide no protection.

The present invention addresses the above-identified and other known drawbacks and disadvantages of prior transformers containment bags.

SUMMARY OF THE INVENTION

An important objective of the invention is to provide a new and unique containment bag for transporting and storage of electrical transformers of the type having a containment vessel containing an electrical insulating and/or heat transfer medium, most commonly a fluid or gel or the like, and transformer coil disposed in the medium in the containment vessel.

A detailed objective is to achieve the foregoing with a containment bag that is capable of both containing and carrying an electrical transformer.

Another detailed objective is to achieve the foregoing with a containment bag that is capable of use with all electrical transformers of the subject type, including but not limited to pole-mount transformers; pad-mount transformers and underground transformers.

These and other objectives and advantages of the invention will become more apparent from the following detailed description when taken in conjunction with the accompanying drawings.

The objectives of the invention are achieved with containment bag that is flexible for ease of carrying on a truck while transporting a transformer, but that is durable to enable lifting and moving the transformer without leaking. The objectives of the invention are achieved with a leak-proof or liquid-tight containment bag that includes a tear-resistant liquid-impervious plastic liner with outer and inner puncture-resistant protective layers, and a bottom that incorporates oil absorbent layers and three layers of cushioning to further protect the liner and protective layers from damage due to weight of transformer.

The objectives of the invention are achieved with a preferred triple-layer barrier containment bag that includes: (i) a durable outer bag made of puncture-resistant liquid-barrier fabric; the outer bag having an open top, surrounding sides, and a closed bottom; the bottom of the outer bag having an inner cushioning oil-absorbent mat; (ii) a middle bag of a tear-resistant liquid-impervious plastic liner (of continuous sheet construction) secured inside the outer bag; the middle bag having an open top, surrounding sides, and a closed bottom; (iii) a durable inner bag made of puncture-resistant liquid-barrier fabric secured inside the liner; the inner bag having an open top, surrounding sides, and a closed bottom; the bottom of the inner bag having outer and inner cushioning oil-absorbent mats; (iv) high strength lifting loops secured to the outer bag; the lifting loops being secured at the front and back of the outer bag on opposite sides of the bag; the lifting loops extending from the top of the outer bag vertically down the height of the bag (in the orientation shown in the drawings; i.e., longitudinally along the length of the bag if otherwise oriented) to at least a midpoint location on the outer bag and to the bottom of the bag for enhanced weight-lifting capacity and being secured to the outer bag along the length thereof; the lifting loops being positionable to extend continuously (uninterrupted)

above the top of the bags from the front to the back of the outer bag to enable grabbing the lifting loops and lifting the bags from above; (v) high strength reinforcing bands secured horizontally (as shown; i.e., circumferentially) around the outer bag and lifting loops secured to the outer bag, the reinforcing bands including (a) an upper reinforcing band secured around the top end of the outer bag and the lifting loops secured thereto, (b) a center reinforcing band secured around said midpoint location of the outer bag and the lifting loops secured thereto, and (c) a lower reinforcing band secured around the bottom of the outer bag and the lifting loops secured thereto; and (vi) a duffel-type top secured to the top of the bags; the duffel-type top having an open condition exposing the top of the bags from above and a closed condition covering and closing off the top of the bags; the duffel-type top having a closure to maintain the duffel-type top in the closed condition; wherein the open tops of the bags include continuous, uninterrupted upper edges defining a surrounded opening through which a transformer may be placed into the bags; wherein the upper ends of the outer, middle and inner bags are secured together around the length thereof; wherein the bags are sized to receive an electrical transformer; and wherein the lifting loops and bags are of sufficient strength to carry an electrical transformer.

Figure 1:
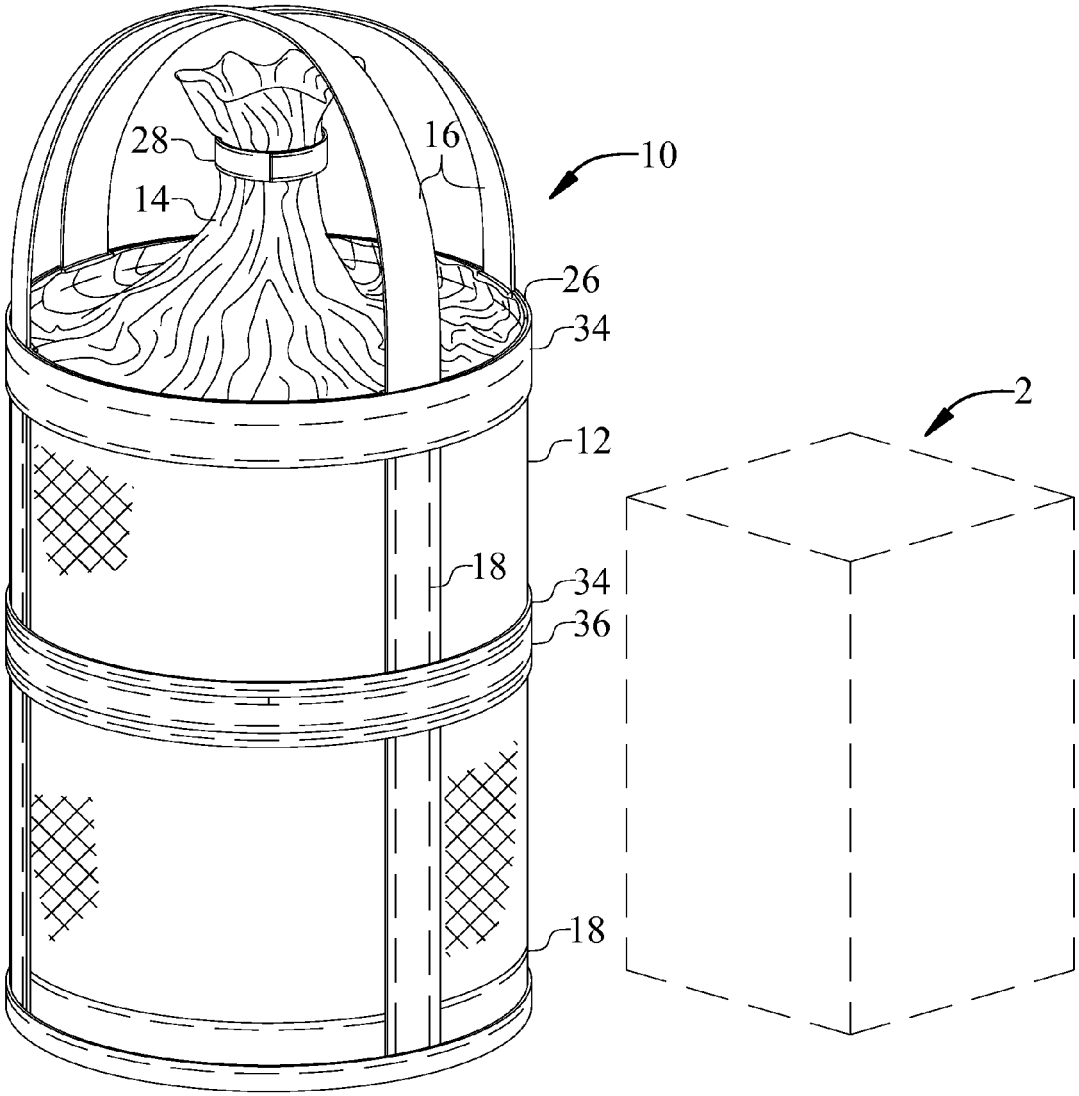
FIG. 1 is a perspective view of a containment bag in accordance with the invention, the bag being shown in a closed condition for transporting and storage of an electrical transformer.

While the invention is susceptible of various modifications and alternative constructions, a certain embodiment is shown in the drawings and described in detail below. It should be understood, however, that there is no intention to limit the invention to the specific form disclosed, but on the contrary, the intention is to cover all modifications, alternative constructions and methods, and equivalents falling within the spirit and scope of the invention.

DETAILED DESCRIPTION OF THE INVENTION

For purposes of illustration, a containment bag in accordance with the invention, for transport and storage of electrical transformers and containment of materials that may leak from the transformers, is shown in the drawings as containment bag 10 for transporting, storage and containment of an electrical transformer 2 represented generically in dashed lines.

The containment bag can be used with any type of electrical transformer, including but not limited to pad mount transformers and underground transformers. Due to its cylindrical shape, the containment bag 10 shown is particularly suited for pole mount transformers that are also generally cylindrical in shape. The containment bag can be alternately made with any convenient cross-section, such as but not limited to a square or rectangular cross-section particularly suited for pad mounted transformers.

Figure 4A:
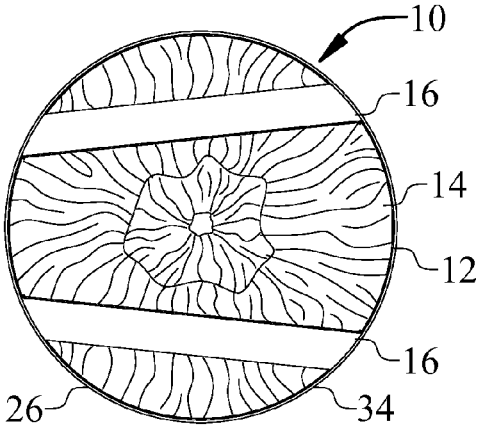
FIG. 4A is a top plan view of the containment bag as shown in FIG. 1.
Figure 5A:
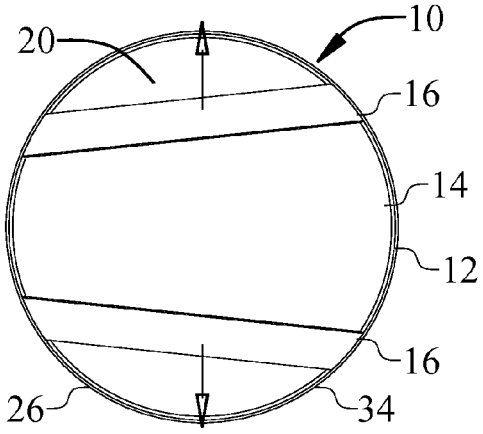
FIG. 5A is a top plan view of the containment bag as shown in FIG. 3.
Figure 4B:
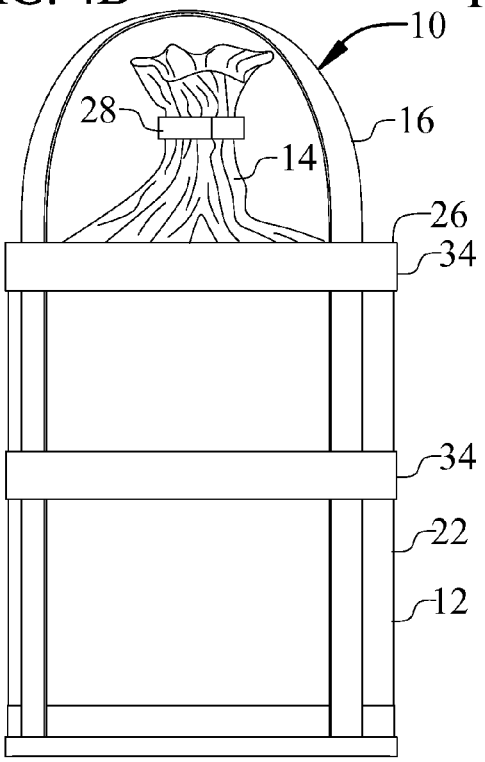
FIG. 4B is a side elevation view of the containment bag as shown in FIG. 1.
Figure 5B:
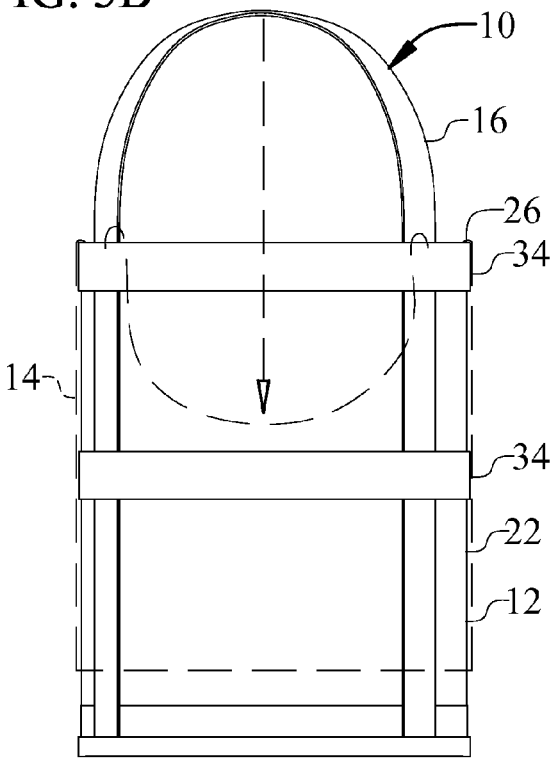
FIG. 5B is a side elevation view of the containment bag as shown in FIG. 3.

Referring to FIG. 1, the containment bag 10 includes a bag 12, a top 14 and lifting loops 16. The bag, top and lifting loops are constructed from flexible woven and sheet materials, and are thus easily movable, flexible and conformable for convenience during use. The containment bag and its several parts are sewn together with high strength thread such as indicated with stitching 18 in dashed lines of a type stitch and thread material that helps maintain liquid-barrier characteristics of the bag (i.e., with continuous water-tight seams). Although the containment bag is shown in the drawings in an upright position, with certain parts and elements shown flat or circular or with other regular geometry, due to the flexible nature of the fabric and material from which the containment bag is made, these various parts and elements may be alternately constructed and may be moved and repositioned for convenience. For example, the lifting straps 16 are shown in an upright position spanning over the top of the bag (see e.g., FIGS. 4A and 5A), but they are relatively flexible and will tend to naturally drape down, and may be repositioned to the side of the bag (as indicated by arrows in FIG. 5A) and to extend down alongside the bag (as indicated by arrow in FIG. 5B) when the bag is not being lifted. Similarly, the bag may be flattened onto its bottom for storage or re-formed as convenient during use of the bag. Similarly, corners that are shown relatively square (in cross-section) in the drawings may be alternately rounded or otherwise configured corners prior to or during use of the bag. However, an important aspect of the preferred bag design is its capability to remain standing upright, i.e., the sides of the bag are somewhat stiff so as to be self-supporting, with its top open for ease of lowering a transformer into an open bag. In this instance, the lifting straps are positioned to the sides of the bag and the top is preferably rolled over to extend downwardly around the bag while the bag is standing to present an unobstructed top opening from above.

The bag 12 shown in the drawings is generally cylindrical (circular in horizontal cross-section), to provide a generally cylindrical containment bag 10, which is typically preferred for evenly distributed high strength throughout the bag with few areas of stress-concentrations. The bag may be alternately constructed with an oval, rectangular or other horizontal cross-section as convenient for the shape of the transformer to be carried and/or contained therein.

Figure 2:
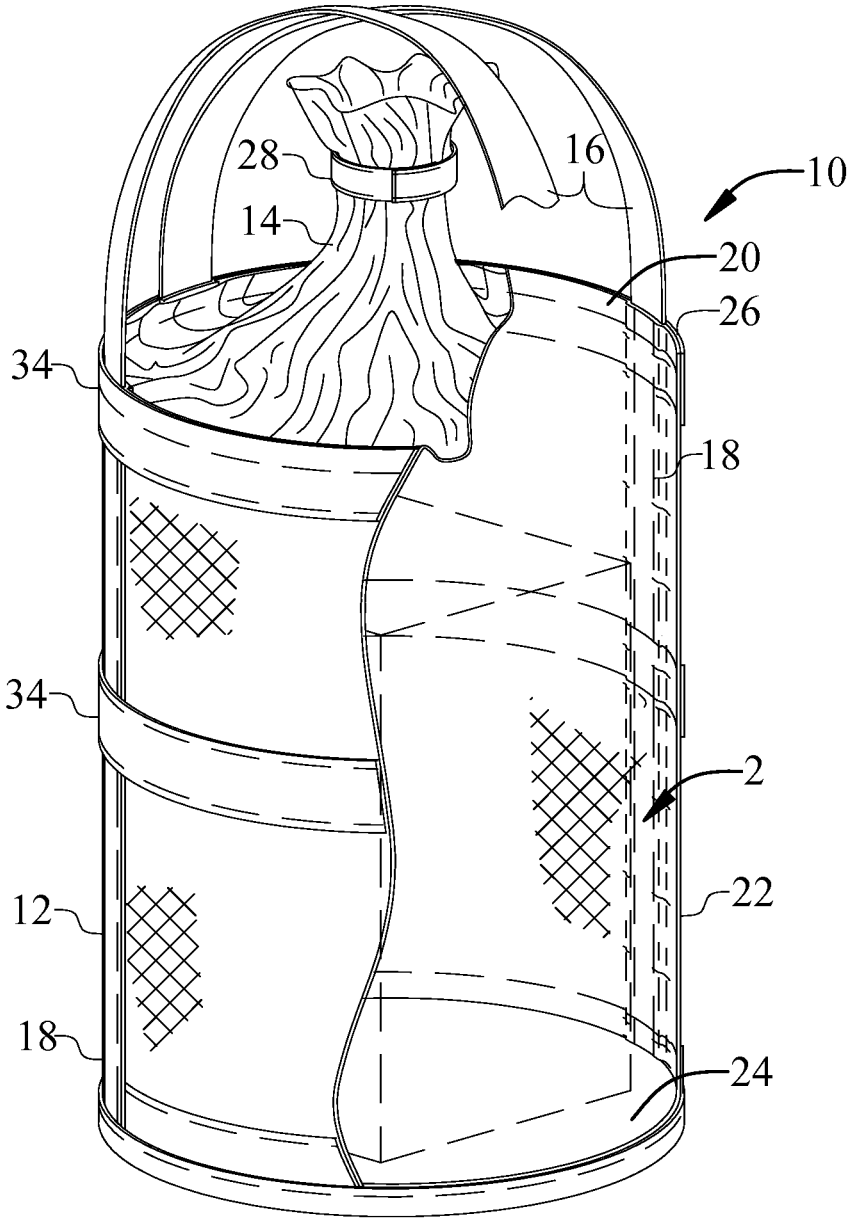
FIG. 2 is a view similar to FIG. 1 with certain parts broken away and shown in cross-section.

Referring to FIG. 2, the bag 12 includes an open top 20, surrounding sides 22, and a closed bottom 24. The bag is constructed to receive an electrical transformer 2 through the open top 20, to carry the transformer when lifted and transported by the lifting loops 16, and to store the transformer isolated from the outside environment with the top 14 in a closed condition.

The open top 20 of the bag 12 is established with a continuous, uninterrupted upper edge 26 at the top of the bag, establishing the surrounded opening through which an electrical transformer can be received into the bag. The preferred continuous, uninterrupted upper edge imparts high strength at the opening, as compared with an opening established by an discontinuous upper edge.

Figure 3:
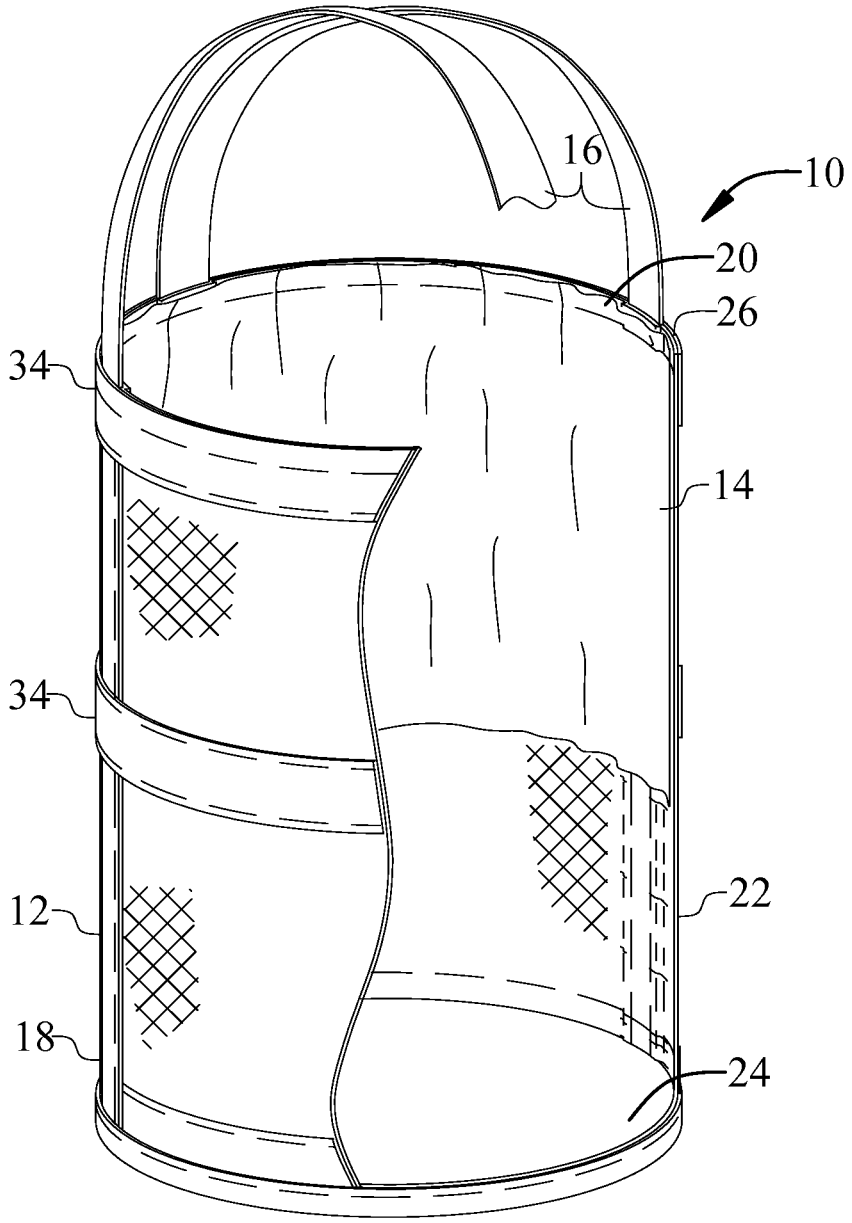
FIG. 3 is a view similar to FIG. 2 but with the containment bag being shown in an open condition, with the duffel top of the containment bag tucked inside the bag.

The top 14 is constructed to open for presentation of the open top 20 of the bag (see e.g., FIG. 3) to enable placing an electrical transformer into the bag, and to close off the open top 20 of the bag (see e.g., FIGS. 1-2) to isolate the transformer in the bag. With the top 14 in the open condition, the bag may be raised to enclose a transformer that is mounted from above, such as certain pole mounted transformers and such other mounting arrangements wherein access to the bottom and sides of the transformer are not restricted. Alternately, for example, with the top in the open condition, the transformer may be simply lowered into the standing bag. As shown in FIG. 3, the top may be conveniently placed in the open condition extending downwardly inside the bag. Alternately, the top may be placed extending above or outside the bag with the lifting loops moved to the sides of the bag.

The top 14 is a duffel-type top established by a length of material with a continuous horizontal cross-section, a sleeve with open ends, with one end secured to the continuous open top 20 of the bag and extending therefrom to the opposite end of the sleeve. The length or height of the top is such that a transformer in the closed bag is completely enclosed.

The preferred duffel top is made from woven polypropylene fabric with a liquid-resistant coating ("coated woven polypropylene fabric").

A closure strap 28 releaseably secures the top 14 in the closed condition over the open top 20 of the bag 12. The closure strap is a hook and loop fastener strip (e.g. Velcro brand fastener) with one end of the strip sewn to the top 14 and the other end of the strip free, and with the length or hook material 30 being on one side of the strip and the length of loop material being on the opposite side, so the fastener can be secured around the top in either direction. The closure strap wraps around the upper end of the top 14 when gathered together as shown in FIGS. 1 and 2, with the hook and loop segments releaseably connecting together, to close the top of the bag. Alternate closures may be used with the duffel top, such as a rope, draw string, or other band-type closure.

The lifting loops 16 are high strength loops secured to the sides 22 of the bag 12. The lifting loops extend above the top of the bag for grabbing or otherwise engaging, to enable lifting of the bag and a transformer contained in the bag by the lifting loops. In the embodiment shown, two lifting loops are provided, one on each side of the bag. The lifting loops shown are high strength straps, made from, for example, high strength woven polyester, to hold the weight of the transformer, with opposite ends of the straps secured to the front and back (in approximately equally angular spacing) on opposite sides of the bag.

The lifting straps are secured longitudinally to the sides of the bag, extending sewn from the top of the bag along at least approximately one half way down the height of the bag. Center and upper reinforcing rings 34 are sewn around the top and center portions of the outside of the bag and around the lifting straps. For preferred enhanced load-carrying capability, the lifting straps extend along the entire length of the bag, and a lower reinforcing ring 50 sewn around the bottom of the bag and bottom ends of the lifting straps further secures the lifting straps to the bag.

The reinforcing rings 34, 50 are also high strength straps, made from, for example, high strength woven polyester, to provide additional reinforcing strength to the bag and the connection between the lifting loops and the bag.

A reflective band 36 is sewn to and around the entire outside of the center reinforcing ring for enhanced visibility of the bag.

The bag 12 provides a high-strength triple-layer liquid-barrier to hold the electric transformer and contain any oil and other materials that might leak from the transformer during transport and storage of the transformer.

The sides 22 of the bag 12 are of tri-wall construction, establishing a triple-layer liquid-barrier side structure that extends continuously (i.e., uninterrupted) around the space to receive the transformer. In general, the walls of the bag consist of a durable outer layer made of a liquid-barrier woven fabric, a middle layer made of a liquid-impervious plastic liner, and a durable inner layer made of the liquid-barrier fabric. The bottom 24 of the bag is similarly constructed, establishing a triple-layer liquid-barrier bottom structure connected to the bottom of the sides 22 in a liquid-tight manner. With this construction, the bottom 24 and sides 22 of the bag 12 establish a liquid-barrier space surrounded on the sides and bottom for containment of the transformer and any liquids or other materials that may leak from the transformer, to prevent leaking of oil and other transformer materials from the bag to the outside environment.

More particularly, the triple-layer sides 22 of the bag 12 are constructed with three layers of liquid-barrier materials comprising an outer layer of woven polypropylene fabric with a liquid-resistant coating ("coated woven polypropylene fabric") (puncture-resistant liquid barrier), an inner layer of the coated woven polypropylene fabric, and a middle layer of nylon PE tear resistant blend (liquid impervious), with each of the three layers extending throughout the entire side structure. The coated woven polypropylene fabric utilizes a liquid barrier type filament in the stitching and fabrication process to further insure the prevention of leakage through the fabric. Coated woven polypropylene fabric is commercially available, such as provided by Berry Plastics Corp. Evansville, Ind. USA. Alternate materials that achieve at least the same strength, durability and liquid-barrier effectiveness may be used in the three-layer construction of the bag; e.g., an industrial "fabric" such as rubber sheet with reinforcing scrim or webbing may be used in place of the coated woven polypropylene fabric in the containment bag.

The bottom 24 of the bag 12 is constructed with a similar triple-layer liquid-barrier construction as the sides 22—comprising an outer layer of the coated woven polypropylene fabric, an inner layer of the coated woven polypropylene fabric, and a middle layer of the nylon PE tear resistant blend—but with the addition of three layers of cushioning oil absorbent mat (16 layer polypropylene), such as commercially available PIG FAT MAT material sold by Newpig Corporation, in Tipton, Pa. USA, which is approximately ¼ inch thick blown polypropylene mesh material, located above each of the three liquid-barrier layers. Thus, the bottom of the bag is constructed with six total layers of materials which, from the inside to the outside surface, consist of an oil absorbent mat; inner coated woven polypropylene fabric; a second oil absorbent mat; the nylon PE tear resistant blend; a third oil absorbent mat; and the outer coated woven polypropylene fabric, with each of the six layers extending throughout the entire bottom structure of the bag.

Figure 6:
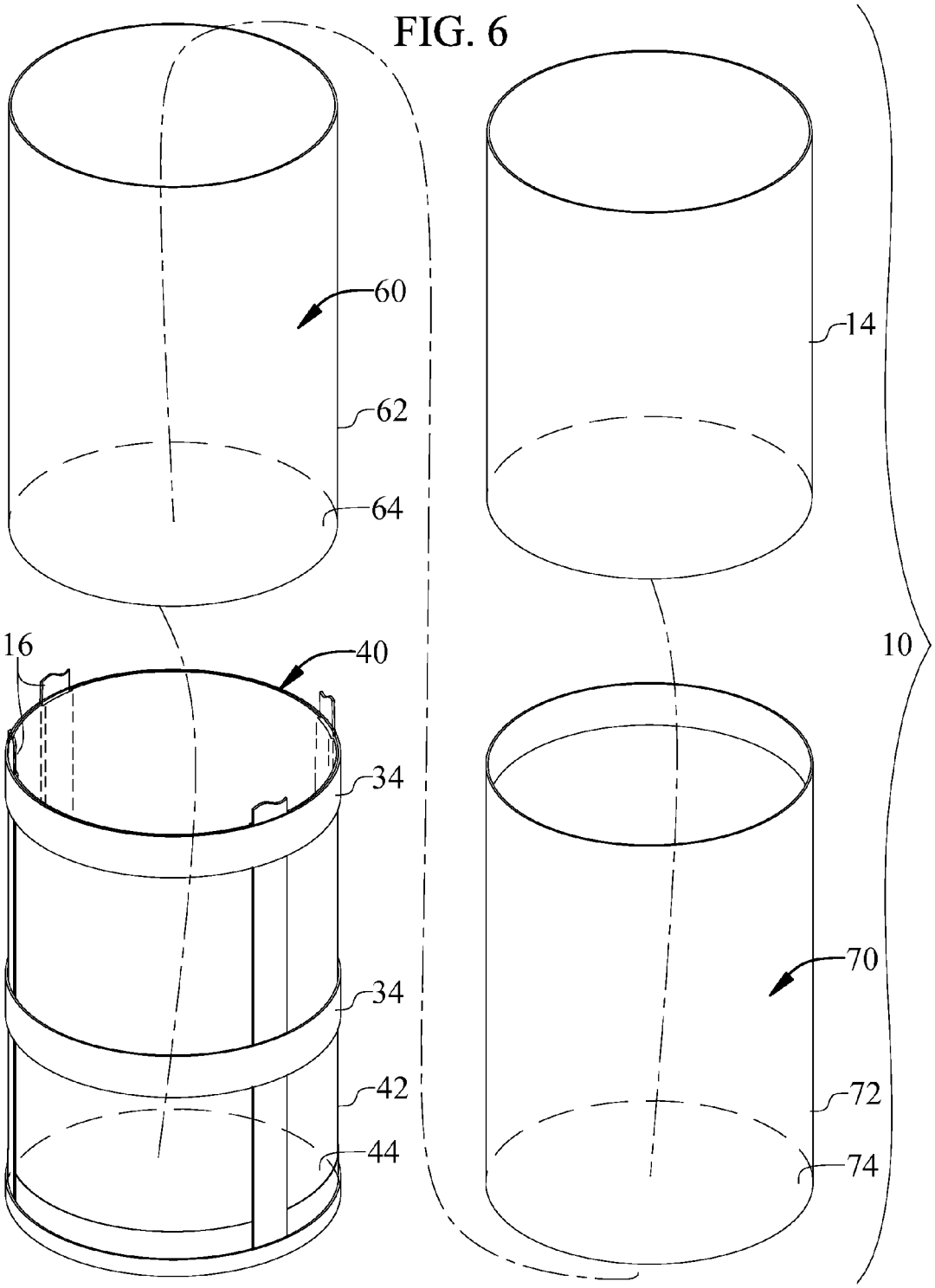
FIG. 6 is an exploded perspective view of the containment bag.

Referring now to FIG. 6, the triple-layer construction of a preferred bag 12 is established with three separate bags, namely, an outer bag 40, a middle bag 60, and an inner bag 70. In general, the outer bag is made of durable liquid-barrier woven fabric, the middle bag is a liquid-impervious plastic liner, and the inner bag is made of durable liquid-barrier fabric, all material as previously described, and sewn together in a leak-proof manner.

The outer bag 40 is generally cylindrical, with a cylindrical sidewall established by a sleeve 42 secured to the round outer profile of a closed bottom 44. The sleeve 42 has a constant cross-section size with top and bottom edges that are perpendicular to the longitudinal axis of the sleeve and are continuous and uninterrupted. The sleeve 42 is formed of coated woven polypropylene fabric.

Figure 7:
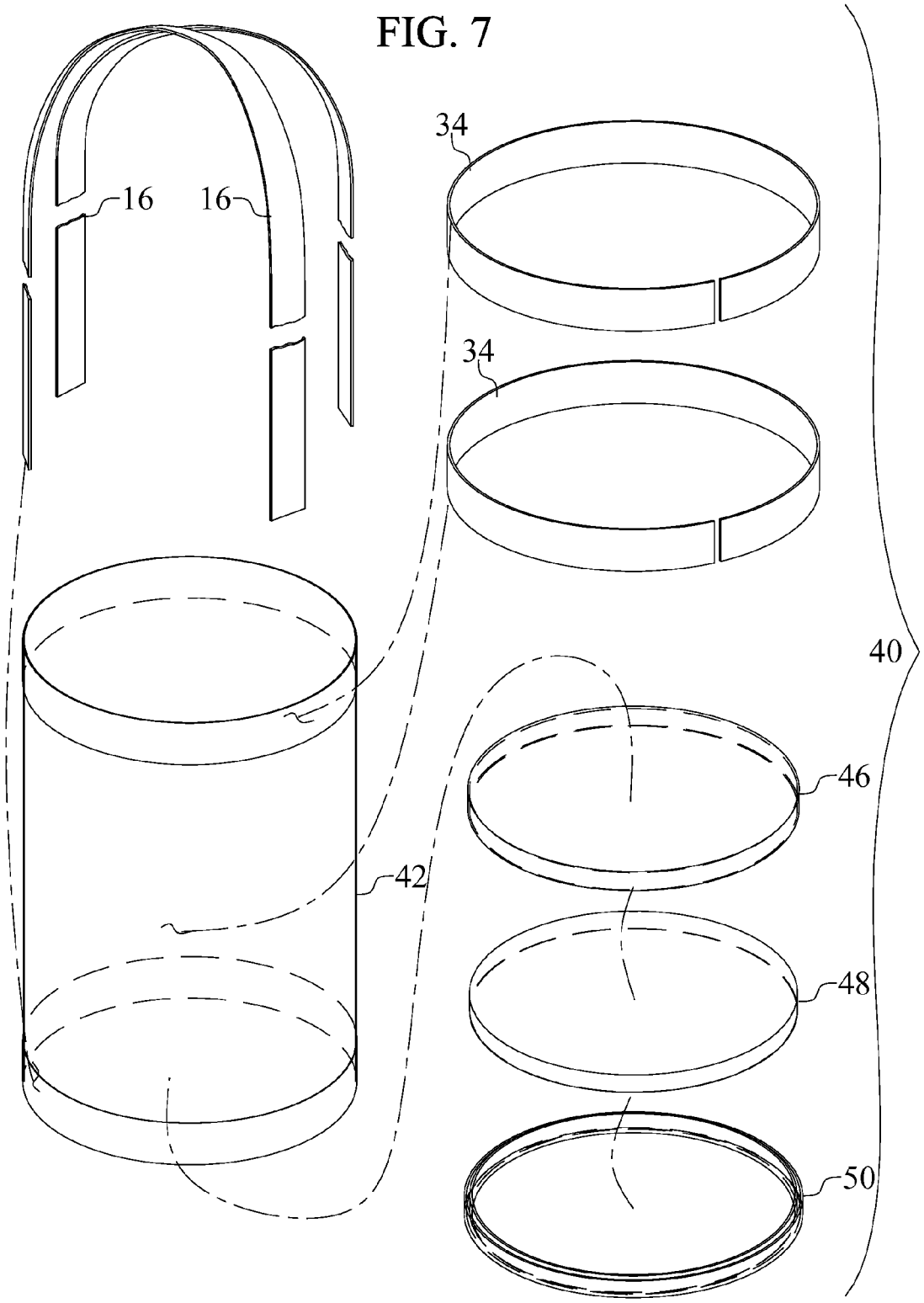
FIG. 7 is an exploded perspective view of an outer bag of the containment bag.

As shown in FIG. 7, the bottom 44 of the outer bag is established with a top layer 46 of oil absorbent mat and a bottom layer 48 of coated woven polypropylene fabric, both layers having a round outer profile. To construct the outer bag, the sleeve 42 is provided in a continuous sleeve form or, for example, by sewing two overlapping edges of a rectangular sheet of coated woven polypropylene fabric together. The lifting rings 16 are sewn longitudinally along opposite sides of the sleeve 42. The center and upper reinforcing rings 34 are sewn to the sleeve 42 over the lifting rings (see FIGS. 8A-B) at the center and top of the sides 42. The reflective band 36 can be sewn to the center reinforcing ring either before or after the center reinforcing ring is sewn to the sides 42 of the outer bag. Turned down peripheral edge-portions of the oil absorbent layer 46 and the coated woven polypropylene fabric layer 48 of the bottom of the outer bag are aligned with the bottom edge of the sleeve 42.

Figure 8A:
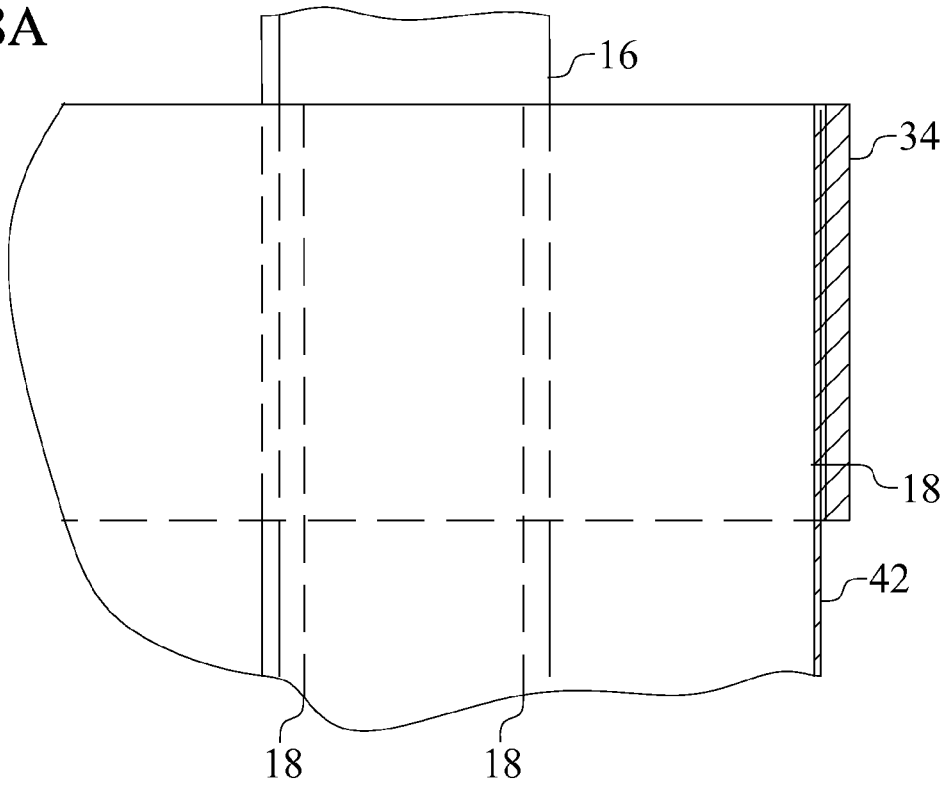
FIG. 8A is an enlarged fragmentary cross-sectional view of the outer bag taken along line 8A-8A of FIG. 6.
Figure 8B:
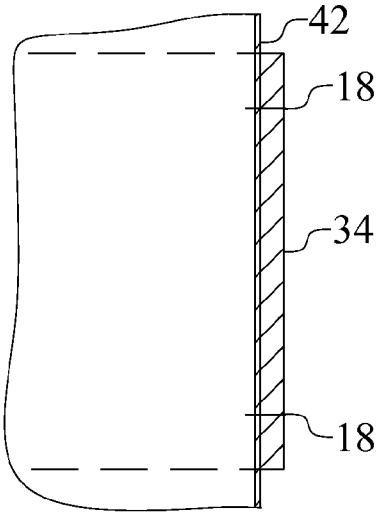
FIG. 8B is an enlarged fragmentary cross-sectional view of the outer bag taken along line 8B-8B of FIG. 6.
Figure 8C:
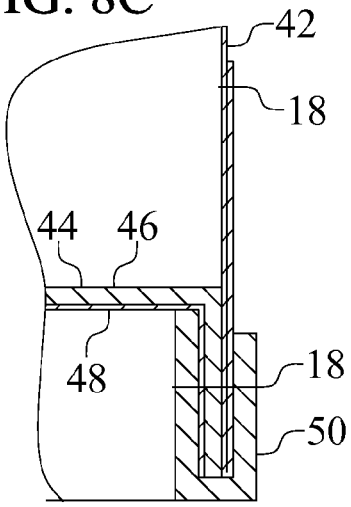
FIG. 8C is an enlarged fragmentary cross-sectional view of the outer bag taken along line 8C-8C of FIG. 6.

A bottom reinforcing ring 50 is wrapped around (along both the inside, bottom and outside) and sewn as indicated by stitching 18 to the bottom edge portion of the sleeve 42 continuously around the circumference thereof, outside of the lower ends of the lifting rings 16, and the turned-down edge-portions of the bottom layers 46, 48 as shown in FIG. 8C to secure the bottom of the outer bag together. It is noted that the lower ends of the lifting rings 16 are sewn under or inside the bottom reinforcing ring 50, i.e., between the bottom of the sleeve 42 and the bottom reinforcing ring 50. As shown in FIGS. 8A and 8C, the upper and lower free ends of the fabric sides 42 are turned over and sewn to secure the free ends and resist fraying of the fabric ends.

The lifting rings 16 extend longitudinally along opposite sides of the sleeve 42 to at least a location mid-way down the height of the bag (to under the center reinforcing ring 34), and for maximum load-lifting capability, to the bottom of the bag (to be secured in the bottom reinforcing ring 50).

The bottom reinforcing ring 50 is a high strength strap as are reinforcing rings 34, made from, for example, high strength woven polyester, to provide additional reinforcing strength at the bottom of the bag and the connection between the lifting loops and the bag. The thickness of this bottom reinforcing ring 50, when doubled over and with the bottom edges of the outer bag and the edges of the turned-down edges of the bottom parts of the outer bag, establish an additionally stiffened ring around the bottom to stiffen the bottom and assist in the bag being capable of use as an upright-standing bag.

The inner bag 70 is generally cylindrical, with a cylindrical sidewall established by a sleeve 72 secured to the round outer profile of a closed bottom 74. The sleeve 72 has a constant cross-section size with top and bottom edges that are perpendicular to the longitudinal axis of the sleeve and are continuous and uninterrupted. The sleeve 72 is formed of coated woven polypropylene fabric.

Figure 9:
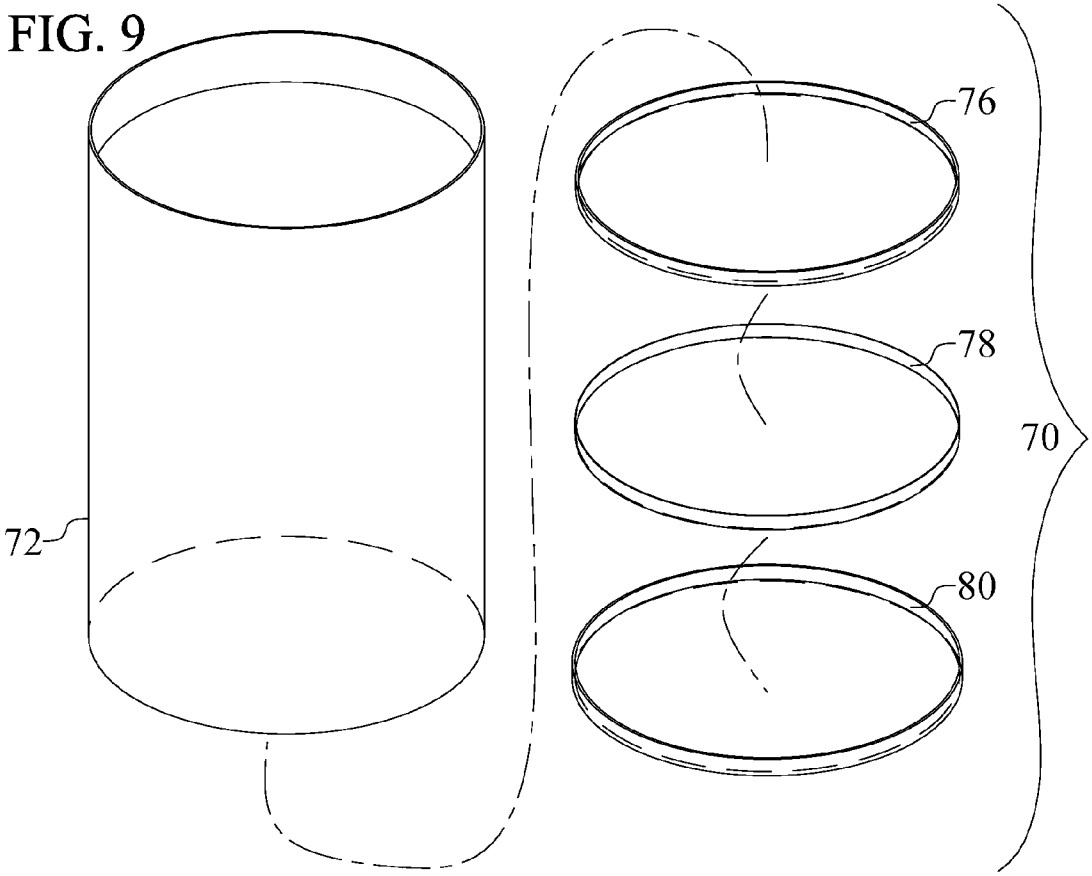
FIG. 9 is an exploded perspective view of an inner bag of the containment bag.
Figure 10A:
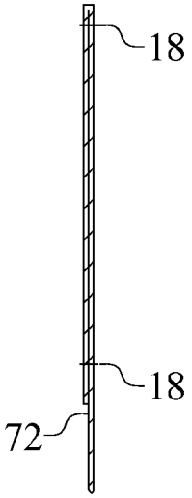
FIG. 10A is an enlarged fragmentary cross-sectional view of the inner bag taken along line 10A-10A of FIG. 6.
Figure 10B:
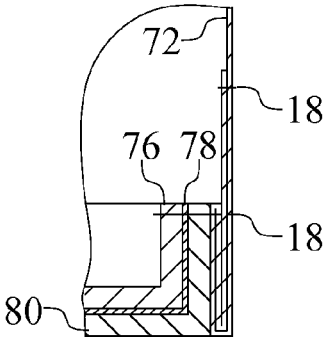
FIG. 10B is an enlarged fragmentary cross-sectional view of the inner bag taken along line 10B-10B of FIG. 6.

As shown in FIG. 9, the bottom 74 of the inner bag is established with a top layer 76 of oil absorbent mat, a middle layer 78 of coated woven polypropylene fabric, and a bottom layer 80 of oil absorbent mat, a three layers having a round outer profile. To construct the inner bag, the sleeve 72 is provided in a continuous sleeve form or, for example, by sewing two overlapping edges of a rectangular sheet of coated woven polypropylene fabric together along the full length thereof. Turned down peripheral edge-portions of the layers 76, 78 and 80 of the bottom of the inner bag (opposite as shown in FIG. 9 wherein layers 76, 78 and 80 are shown with turned up peripheral edge portions) are aligned with and sewn to the bottom edge of the sleeve 72 continuously around the circumference thereof, and the sleeve and bottom are turned inside-out in relation to one another to obtain the bottom configuration with turned up peripheral edge portions as shown in see FIG. 10B. As shown in FIGS. 10A and 10B, the upper and lower free ends of the fabric sides 72 are turned over and sewn to secure such free ends and resist fraying of the fabric ends.

The middle bag 60 is a tear-resistant liquid-impervious (i.e., watertight) plastic liner, with no material junctions, holes or perforations, sewing seams or the like, except at the very top when secured between the outer bag 40 and inner bag 70. The middle bag is formed from a sheet of flexible nylon PE tear resistant blend, with the sides of the sheet drawn up into a shape having generally cylindrical sides 62 and a closed bottom 64 as shown in FIG. 6. One suitable tear-resistant plastic liner is LF5000 material sold under the WINPAK brand, Senoia, Ga., USA, which is an LLDPE-tie-NYLON-tie-NYLON-tie-mPE composition. Alternate materials from which the tear-resistant liner can be made include a nylon/polyethylene blend.

The cylindrical top sleeve 14 is provided in a continuous sleeve form or, for example, by sewing two overlapping edges of a rectangular sheet of coated woven polypropylene fabric together along the full length thereof. Binding stitch may be provided around the upper and lower ends of the sleeve to resist fraying of the fabric ends of the sleeve.

Figure 11:
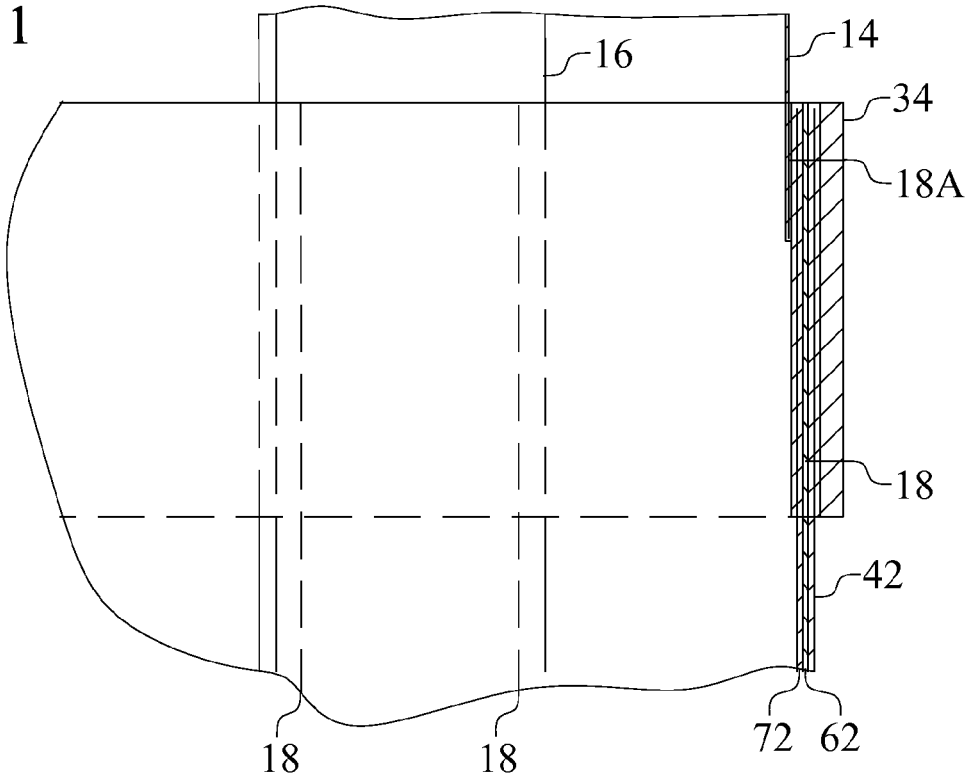
FIG. 11 is an enlarged fragmentary cross-sectional view of the containment bag taken along line 11-11 of FIG. 1.

With the outer bag 40, middle bag 60, inner bag 70 and sleeve 14 prepared as described above, the containment bag 10 is constructed by positioning the top sleeve, inner bag and middle bag in the outer bag, and sewing the top ends of the three bags and the bottom of the sleeve 14 together, continuously around the circumference thereof, as indicated at 18A in FIG. 11 (wherein the sleeve is shown extending up from the top of the bags). The top edge of the liner establishing the middle bag can then be trimmed as shown after the bags are sewn together. To maintain the liquid-impervious integrity of the middle bag, the seam at the tops of the bags is the only seam penetrating through the middle bag.

Figure 12:
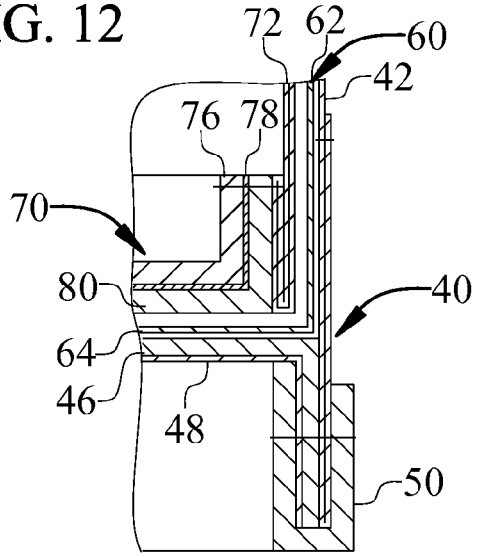
FIG. 12 is an enlarged fragmentary cross-sectional view of the containment bag taken along line 12-12 of FIG. 1.

The resulting triple-layer liquid-barrier construction of the bag 12, with the additional alternating liquid-absorbent layers at the bottom of the bag, is shown in cross-section in FIG. 12.

For illustrative purposes, one containment bag which has been tested and found to be suitable for transporting and storage of transformers of approximately 2500 lb. is constructed with the following overall characteristics: the bag is 48 inches tall and 42 inches diameter, the top sleeve is 48 inches tall, the carrying straps are 26 inches length above the height of the bag and 2 inches wide, the reinforcing rings are 2 inches wide, the outer and inner bags are made from 7 oz. woven polypropylene fabric with a liquid-resistant coating, the middle bag is made from 6 mil. 7 layer nylon PE tear resistant blend, and the duffel top is made from 3 oz. coated woven polypropylene fabric. The reinforcing rings and lifting loops are 12,000-lb. test woven polyester. The bag is sewn together with 84-lb. test polyester thread.

Advantageously, in extreme circumstances the bags can puncture or tear, but the materials used and bag design will not allow for propagation of these punctures or tears. Most of the sharp parts of a pole mount transformer are located near the top of the transformer. The size of the containment bag used to contain and transport a transformer is selected so that these sharp parts of a pole mount transformer are located above the center reinforcing ring of the containment bag. In the event that a sharp object does puncture through the containment bag, the puncture will be located above the center ring, the center and upper reinforcing rings will contain the puncture and any resulting further rip in the side of the bag, and any hazardous liquid that may have leaked into the containment bag will remain contained because it is located at the bottom of the bag well below the center reinforcing ring.

Pole mount transformers are available in numerous sizes, but the larger pole mount transformers can weigh up to approximately 2000 pounds. The preferred containment bag disclosed herein has been tested to successfully contain such large transformers through normal expected transport conditions.

Conveniently, as previously noted, the bag may be flattened onto its bottom for storage and transport of an empty bag such as in a separate thin bag with a carrying handle.

In use, the containment bag is placed upright and free standing on the ground with the top of the bag open and preferably the duffel top telescoped down along the outside of the bag and the lifting loops. A leaking transformer is carefully lowered into the standing open containment bag and the top of the bag is closed so that no additional leaking occurs from the transformer. The transformer can then be safely lifted and moved by the lifting loops of the bag.

From the foregoing, it will be apparent that the containment bag is uniquely capable of receiving a transformer, carrying and moving the transformer using the lift loops, and enclosing and storing the transformer without leaking from the bag. There is no other containment bag that can completely contain a leaking transformer while enabling lifting of the transformer with the lifting loops of the bag to transport and store the transformer.

I claim:

1. A transformer containment bag comprising:

a durable outer bag made of puncture-resistant liquid-barrier fabric, the outer bag having an open top, surrounding sides, and a closed bottom, the bottom of the outer bag comprises an inner cushioning oil-absorbent mat;

a second bag of a tear-resistant liquid-impervious liner secured inside the outer bag having an open top secured to the open top of the outer bag, the second bag further comprising surrounding sides and a closed bottom;

a high strength lifting loop secured to the outer bag; the lifting loop being secured at the front and back of the outer bag on opposite sides of the bag; the lifting loop extending from the top of the outer bag vertically down the height of the bag; the lifting loop being positionable to extend above the top of the bags to enable grabbing the lifting loop and lifting the bags from above;

a high strength reinforcing band secured horizontally around the outer bag and the lifting loop; and a duffel top secured to the top of the bags, the duffel top having an open condition exposing the top of the bags from above and a closed condition covering and closing off the top of the bags; the duffel top having a closure to maintain the duffel top in the closed condition;

wherein the open tops of the bags include upper edges defining a surrounded opening through which a transformer may be placed into the bags; wherein the upper ends of the outer and second bags are secured together around the length thereof; wherein the bags are sized to receive an electrical transformer.

2. The transformer containment bag of claim 1 wherein the bottom of the outer bag comprises an inner cushioning oil-absorbent mat.

3. The transformer containment bag of claim 1 further comprising:

a durable inner bag made of puncture-resistant liquid-barrier fabric and secured on the inside of the second bag, the inner bag having an open top secured to the open tops of the outer bag and the second bag, the inner bag further comprising surrounding sides and a closed bottom.

4. The transformer containment bag of claim 1 wherein the second bag is made from a continuous sheet.

5. The transformer containment bag of claim 3 wherein the bottom of the inner bag comprises outer and inner cushioning oil-absorbent mats.

6. The transformer containment bag of claim 1 further comprising:

a plurality of high strength lifting loops secured to the outer bag, the lifting loops being secured at the front and back of the outer bag on opposite sides of the bag, the lifting loops extending from the top of the outer bag vertically down the height of the bag, the lifting loops being positionable to extend above the top of the bags to enable grabbing the lifting loops and lifting the bags from above.

7. The transformer containment bag of claim 1 wherein the reinforcing band is positioned around a center height location of the outer bag and lifting loop.

8. The transformer containment bag of claim 1 further comprising:

a plurality of reinforcing bands, the reinforcing bands including an upper reinforcing band secured around the top end of the outer bag and lifting loop, a center reinforcing band secured around a center height location of the outer bag and lifting loop, and a lower reinforcing band secured around the bottom of the outer bag and the lifting loop.

9. The transformer containment bag of claim 3 further comprising:

a plurality of reinforcing bands, the reinforcing bands including an upper reinforcing band secured around the top end of the outer bag and lifting loop, a center reinforcing band secured around a center height location of the outer bag and lifting loop, and a lower reinforcing band secured around the bottom of the outer bag and the lifting loop.

10. A transformer containment bag comprising:

a leak-tight bag of multi-wall construction, with an open top, a first multi-layer liquid-barrier side structure, and a second multi-layer liquid-barrier bottom structure at the bottom of the side structure;

the first multi-layer liquid-barrier side structure having an outer puncture-resistant liquid-barrier fabric layer and a tear-resistant liquid-impervious liner secured inside the outer layer, the outer layer and the liner having open tops secured together to establish an open top for the bag;

the second multi-layer liquid-barrier bottom structure having an outer puncture-resistant liquid-barrier fabric layer with an inner cushioning oil-absorbent mat, and a tear-resistant liquid-impervious liner secured inside the outer layer;

a high strength lifting loop secured longitudinally along the length of the bag side structure and positionable above the open top of the bag to enable grabbing the lifting loop and lifting the bag from above;

a high strength reinforcing band secured around the bag side structure and lifting loop; and a duffel top secured to the top of the bag side structure and openable for exposing the open top of the bag from above;

wherein the open top of the bag defines a surrounded opening through which a transformer may be placed into the bag; wherein the upper ends of the side structure layers are secured together around the length thereof; wherein the bag is sized to receive an electrical transformer; and wherein the lifting loops and bag are of sufficient strength to lift and carry the electrical transformer.

11. The transformer containment bag of claim 10 wherein the first multi-layer liquid-barrier side structure further comprises an inner puncture-resistant liquid-barrier fabric secured on the inside of the liner.

12. The transformer containment bag of claim 10 wherein the liner of the side structure is made from a continuous sheet.

13. The transformer containment bag of claim 10 wherein the second multi-layer liquid barrier bottom structure further comprises an inner puncture-resistant liquid-barrier fabric secured on the inside of the liner.

14. The transformer containment bag of claim 10 wherein the liner of the bottom structure is made from a continuous sheet.

15. The transformer containment bag of claim 13 wherein the inner layer of the bottom structure comprises outer and inner cushioning oil-absorbent mats.

16. The transformer containment bag of claim 10 further comprising:

a plurality of high strength lifting loops secured longitudinally along the length of the bag side structure and positionable above the open top of the bag to enable grabbing the lifting loops and lifting the bag from above.

17. The transformer containment bag of claim 10 wherein the reinforcing band is positioned around a center height location of the outer layer and lifting loop.

18. The transformer containment bag of claim 10 further comprising:

a plurality of reinforcing bands, the reinforcing bands including an upper reinforcing band secured around the top end of the outer layer and lifting loop, a center reinforcing band secured around a center height location of the outer layer and lifting loop, and a lower reinforcing band secured around the bottom of the outer layer and the lifting loop.

* * * * *